US007027008B2

(12) United States Patent
Baker

(10) Patent No.: US 7,027,008 B2
(45) Date of Patent: Apr. 11, 2006

(54) ANTENNA GROUND SYSTEM

(75) Inventor: William W. Baker, Hudsonville, MI (US)

(73) Assignee: Information Station Specialists, Zeeland, MI (US)

( * ) Notice: Subject to any disclaimer, the term of this patent is extended or adjusted under 35 U.S.C. 154(b) by 67 days.

(21) Appl. No.: 10/856,055

(22) Filed: May 28, 2004

(65) Prior Publication Data

US 2005/0264465 A1 Dec. 1, 2005

(51) Int. Cl.
*H01Q 1/12* (2006.01)

(52) U.S. Cl. ..... 343/890; 343/846

(58) Field of Classification Search ..... 343/846, 343/890

See application file for complete search history.

(56) References Cited

U.S. PATENT DOCUMENTS

| | | | | |
|---|---|---|---|---|
| 1,001,228 A | | 8/1911 | Stokes et al. | 343/847 |
| 1,214,591 A | | 2/1917 | Reuthe | 343/725 |
| 1,640,929 A | | 8/1927 | Farkouh | 343/816 |
| 2,193,859 A | | 3/1940 | Buschbeck | 343/848 |
| 2,501,430 A | | 3/1950 | Alford | 343/741 |
| 3,048,845 A | | 8/1962 | Becker | 343/830 |
| 4,099,184 A | * | 7/1978 | Rapshys | 343/875 |
| 4,184,165 A | * | 1/1980 | Vye | 343/874 |
| 5,446,473 A | * | 8/1995 | Nielsen | 343/890 |
| 5,495,261 A | | 2/1996 | Baker et al. | 343/846 |
| 6,496,154 B1 | * | 12/2002 | Gyenes | 343/745 |
| 2002/0140621 A1 | * | 10/2002 | Harrison | 343/890 |

FOREIGN PATENT DOCUMENTS

| | | |
|---|---|---|
| GB | 246444 | 10/1925 |
| GB | 1268344 | 3/1972 |

OTHER PUBLICATIONS

"Highway Advisory Radio with Triad Ground System", Highway Information Systems, Inc., offered for sale at least as early as May 1, 2003.

* cited by examiner

*Primary Examiner*—Tho Phan
(74) *Attorney, Agent, or Firm*—Price, Heneveld, Cooper, DeWitt & Litton, LLP

(57) ABSTRACT

An antenna system includes an electrical grounding system for a low power radio transmitter of a traveler's information station. The antenna system includes an elongated metal tube having a lower portion configured to be received in the ground and an upper portion adapted to support an antenna above ground. The tube includes an intermediate portion at a service height when the tube is positioned upright in the ground. The antenna system includes an antenna structure secured to the upper portion of the tube at least partially outside the tube. At least one elongated conductive ground member secured to a lower end of the tube and extends along an outside of the tube below ground, and within the tube above ground. The elongated ground member is coupled to the tube above the ground.

25 Claims, 5 Drawing Sheets

FIG. 3
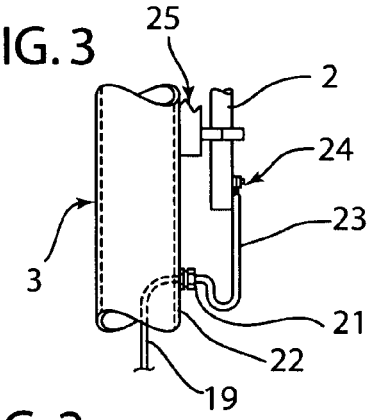
FIG. 2
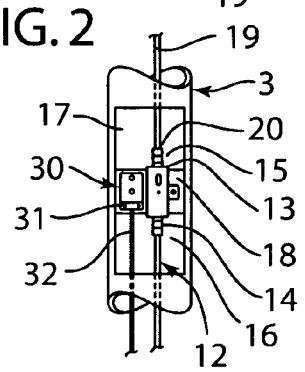
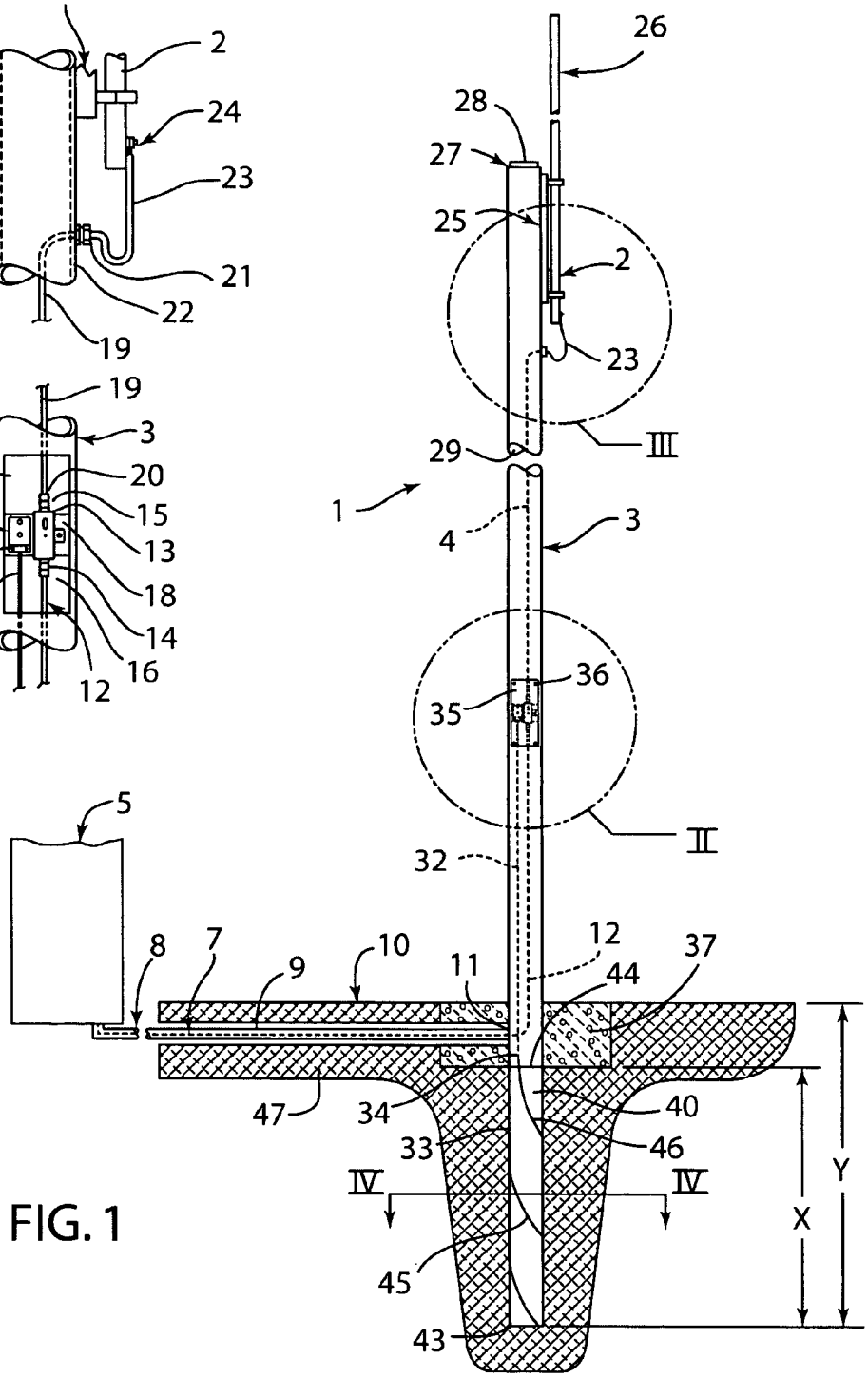
FIG. 1

ANTENNA GROUND SYSTEM

BACKGROUND OF THE INVENTION

It is common practice in the installation of AM broadcast stations to put in an extensive ground system buried in the earth. In fact, the Federal Communications Commission (FCC) has mandated that each standard AM broadcast station be equipped with a ground system consisting of at least 120 radials, each being at least one-quarter wavelength in length. For the typical broadcast frequencies of 540 kHz to 1,700 kHz, this amounts to approximately 18,000 to 49,000 feet of wire which would occupy approximately 2 to 15 acres of clear land. The ground system for the typical AM broadcast antenna can be seen to be a very expensive and large undertaking.

The traveler's information AM broadcast stations, which are frequently seen at the entrances to airports, state parks, national parks and even at state borders, operate at a frequency in the range of approximately 530 kHz to 1,710 kHz, which is slightly below and slightly above the standard broadcast range of frequencies. The FCC has waived the above-mentioned ground system requirement for traveler's information stations; however, a practical station still requires a ground system in order for the antenna to radiate an effective signal. The small, low power, limited range transmitters employed in the traveler's information service cannot justify the expense of the typical antenna ground system. Even the amount of land occupied by a conventional ground system at the authorized frequencies would be prohibitive.

Known antenna ground systems may include a plurality of wires or other conductors that extend outwardly away from the antenna, generally parallel to the ground surface. Because of the large area required for the ground plane, the antenna cannot be positioned adjacent buildings or other structures. Furthermore, extensive labor may be required to install such ground planes.

SUMMARY OF THE INVENTION

One aspect of the present invention is an antenna system including an electrical grounding system for a low power radio transmitter of a traveler's information station. The antenna system includes an elongated metal tube having a lower portion configured to be received in the ground and an upper portion adapted to support an antenna above ground. The tube includes an intermediate portion at a service height when the tube is positioned upright in the ground. The antenna system includes an antenna structure secured to the upper portion of the tube at least partially outside the tube. At least one elongated conductive ground member secured to a lower end of the tube and extends along the outside of the tube below ground, and within the tube above ground. The elongated ground member is coupled to the tube above the ground. The antenna system further includes an elongated conductor extending upwardly inside the tube from the intermediate portion to the upper portion of the tube. The elongated electrical conductor is electrically coupled to the antenna structure.

Another aspect of the present invention is a transmitter system including an elongated metal tube defining an elongated cavity. The tube has a lower portion configured to be positioned below a ground level, and an upper portion configured to support an antenna above ground. The transmitter system also includes a transmitter positioned remote from the tube and generating signals in a frequency range of between approximately 530 kHz and 1,710 kHz at low power for limited range traveler's information station. A transmitting antenna is secured to the upper portion of the tube, and a coaxial cable has a portion thereof positioned in the cavity. The coaxial cable has an elongated inner conductor that electrically couples the transmitter to the transmitting antenna, and an outer conductor electrically coupled to the tube. The coaxial cable extends through a sidewall of the lower portion of the tube and extends below ground to the transmitter.

Another aspect of the present invention is a transmitting system including an elongated tube made of a conductive material. The tube defines an internal cavity, an upper portion for supporting an antenna above a ground surface, and a lower portion configured to extend below ground to support the tube in a generally upright position and to electrically ground the tube. A transmitting antenna is secured to the upper portion of the tube, and an elongated electrical conductor is coupled to the transmitting antenna and extends through the internal cavity and exits the tube below ground at the lower portion of the tube. A transmitter generates signals to the antenna through the elongated electrical conductor.

These and other features, advantages, and objects of the present invention will be further understood and appreciated by those skilled in the art by reference to the following specification, claims, and appended drawings.

BRIEF DESCRIPTION OF THE DRAWINGS

FIG. 1 is a partially schematic elevational view of an antenna and transmitting system according to one aspect of the present invention;

FIG. 2 is an enlarged view of a portion of the transmitting system of FIG. 1 showing the lightning arrestor and grounding features;

FIG. 3 is a fragmentary, enlarged portion of the transmitting system of FIG. 1 showing the mounting of the antenna;

FIG. 1;

DETAILED DESCRIPTION OF PREFERRED EMBODIMENT

Figure 4:
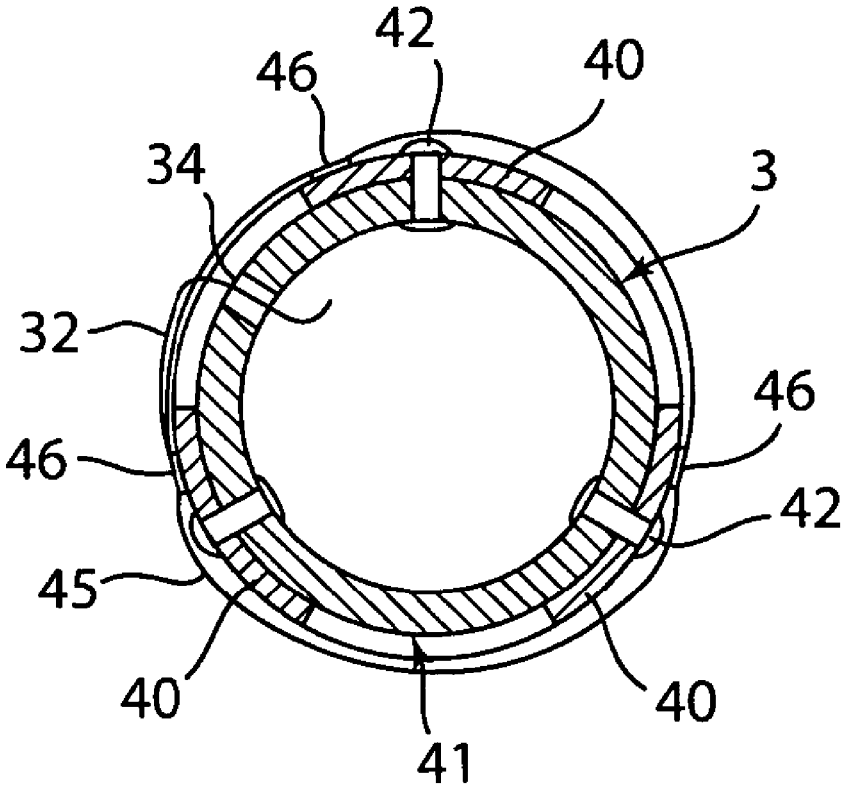
FIG. 4 is a cross-sectional view taken along the line IV—IV.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a transmitting system 1 according to the present invention includes an antenna 2 that is secured to a pole formed by an elongated tube 3 made of a conductive metal material such as aluminum. An elongated conductor such as a coaxial cable 4 connects the antenna 2 to a transmitter 5 that may be positioned remote from the tube 3. As discussed in more detail below, cable 4 includes a lower cable section 7 that runs from the transmitter 5 to a lightning arrestor 13 (FIG. 2), and an upper cable section 19 that runs from lightning arrestor 13 to antenna 2. The transmitter 5 may be a Traveler's Information Station ("TIS") of a known design operating AM-band frequencies between 530 and 1,700 kHz. Such transmitters are available from Information Station Specialists ("ISS") of Zeeland, Mich., assignee of the present patent application. The transmitter 5 may transmit one or more prerecorded messages to motorists in a 3-to-5 mile radius from the antenna 2.

Cable section 7 includes a horizontal section 8 that runs from the transmitter 5 through a conduit 9 that is buried below the ground surface 10 and a vertical section 12 that extends vertically in tube 3 to lightning arrestor 13. The conduit 9 is connected to the tube 3 at an opening 11 in the tube. The conduit 9 may be sealed to the tube 3 at opening 11 to prevent entry of moisture and the like. Vertically extending section 12 of the coaxial cable 7 extends upwardly from horizontal section 8 to lightning arrestor 13 (FIG. 2), and a conventional coaxial terminal connector 16 of the cable section 7 is electrically coupled to a first coaxial connector 14 of lightning arrestor 13. Lightning arrestor 13 is of a known design, such as a LAO1 lightning arrestor available from ISS, and is mounted to the tube 3 via a mounting block 18. The lightning arrestor 13 connects the outer conductor of the coaxial cable to the tube 3 to thereby ground the coaxial cable to the tube 3. The upper section 19 (FIG. 3) of cable 7 includes a coaxial terminal end 20 that is connected to a second connector 15 of lightning arrestor 13. The upper section 19 of coaxial cable 7 extends upwardly within the tube 3, and extends through a sidewall 22 of tube 3 through a liquidtight cord grip fitting 21 that provides a waterproof seal. A section 23 of cable 19 connects to the antenna 2 utilizing conventional connection hardware 24. A bracket 25 securely connects the antenna 2 to the outside of the tube 3, with the upper portion 26 of the antenna extending upwardly above the upper end 27 of tube 3. A cap or cover 28 closes off the end 27 of tube 3 to ensure that moisture does not enter the interior 29 of tube 3.

A grounding block 30 (FIG. 2) is welded or otherwise physically and electrically coupled to the tube 3. Grounding block 30 includes a clamp 31 that secures the grounding block 30 to an elongated grounding line 32 to thereby ground the tube 3 to the grounding line 32. The grounding line 32 is made of a conductive material such as copper, and extends downwardly to a lower portion 33 of tube 3, where it exits the tube through a small opening 34 below the ground level 10. The opening 34 is preferably sealed utilizing a fitting or the like (not shown) to prevent entry of moisture or the like into the interior space 29 of tube 3. An access cover 35 selectively closes off the access opening 17 to prevent unauthorized access to the lightning arrestor 13, grounding block 30, and other components. The access cover 35 may be secured to the tube 3 utilizing conventional threaded fasteners 36 or the like. The access opening 17 is preferably at an access height of around, for example, four feet above the ground surface 10, so that it provides convenient access for servicing, installation, and the like.

With further reference to FIG. 4, one or more elongated copper plates 40 are secured to the outside 41 of tube 3 utilizing fasteners 42. The fasteners 42 may be screws, rivets, or the like. The copper plates 40 are made of a conductive material such as malleable copper having a thickness of about 0.029 inches that is formed to fit closely around the outside surface 41 of tube 3. The plates 40 extend a distance "X" (FIG. 1) upwardly from the lower end 43 of tube 3. The length X may be about four feet, with the end 43 of tube 3 positioned a distance "Y" below the ground surface 10. The dimension Y may be about six feet, such that the upper ends 44 of plates 40 are about two feet below the ground surface 10. The total length of tube 3 may be at least about twenty-four feet such that upper end 27 of tube 3 is about eighteen feet above the ground surface 10. A lower portion 45 of the ground wire 32 is positioned outside tube 3 and spirals around the plates 40 at the lower portion 33 of tube 3 to further ground the tube 3. The lower portion 45 of ground wire 32 is electrically and mechanically interconnected to the plates 40 and/or tube 3 by brazing 46 or other suitable arrangement. For purposes of illustration, the lower portion 45 of ground wire 32 is shown in FIG. 4 as being "loose." It will, however, be understood that lower portion 45 of ground wire 32 may be tightly wrapped around plates 40.

The copper plates 40 and ground line 32 together provide a relatively large contact area with the soil 47, and thereby electrically ground the tube 3. Tube 3 may be made of an aluminum material having an outer diameter of about six inches, and a wall thickness of about 0.029 inches. Alternately, the tube 3 could be made of other suitable conductive materials, and could have other cross sectional shapes. The tube 3 provides a very durable enclosure for the cables, and also provides a ground for the antenna. As discussed above, the conductive plates 40 may be made of a copper material. Alternatively, other highly conductive materials such as gold having properties sufficient to form a ground with the soil 47 may also be utilized. Also, the entire pole 3 could be made of copper or highly conductive material, such that plates 40 are not required.

During installation, a hole for the tube 3 is dug, and the lower portion of the tube 3 is inserted in the ground. The underground conduit 9 and horizontal section 8 of coaxial cable 7 are then positioned in a trench or the like to extend from the transmitter 5 to the tube 3. The section 12 of cable 7 is then extended through the internal cavity of the tube 3 and connected to the connector 14 of lightning arrestor 13. The earth or soil 47 is filled in around the lower portion of the tube and compacted downwardly. The section 19 of coaxial cable 4 extending from the antenna 2 to the lightning arrestor 13 may be pre-installed prior to positioning of tube 3 in the ground. The ground line 32, grounding block 30, copper plates 40, and antenna 2 may also be pre-installed. The upper portion of the hole dug to receive pole 3 may optionally be filled with concrete to form a concrete collar 37 to provide additional support for the tube 3.

Figure 5:
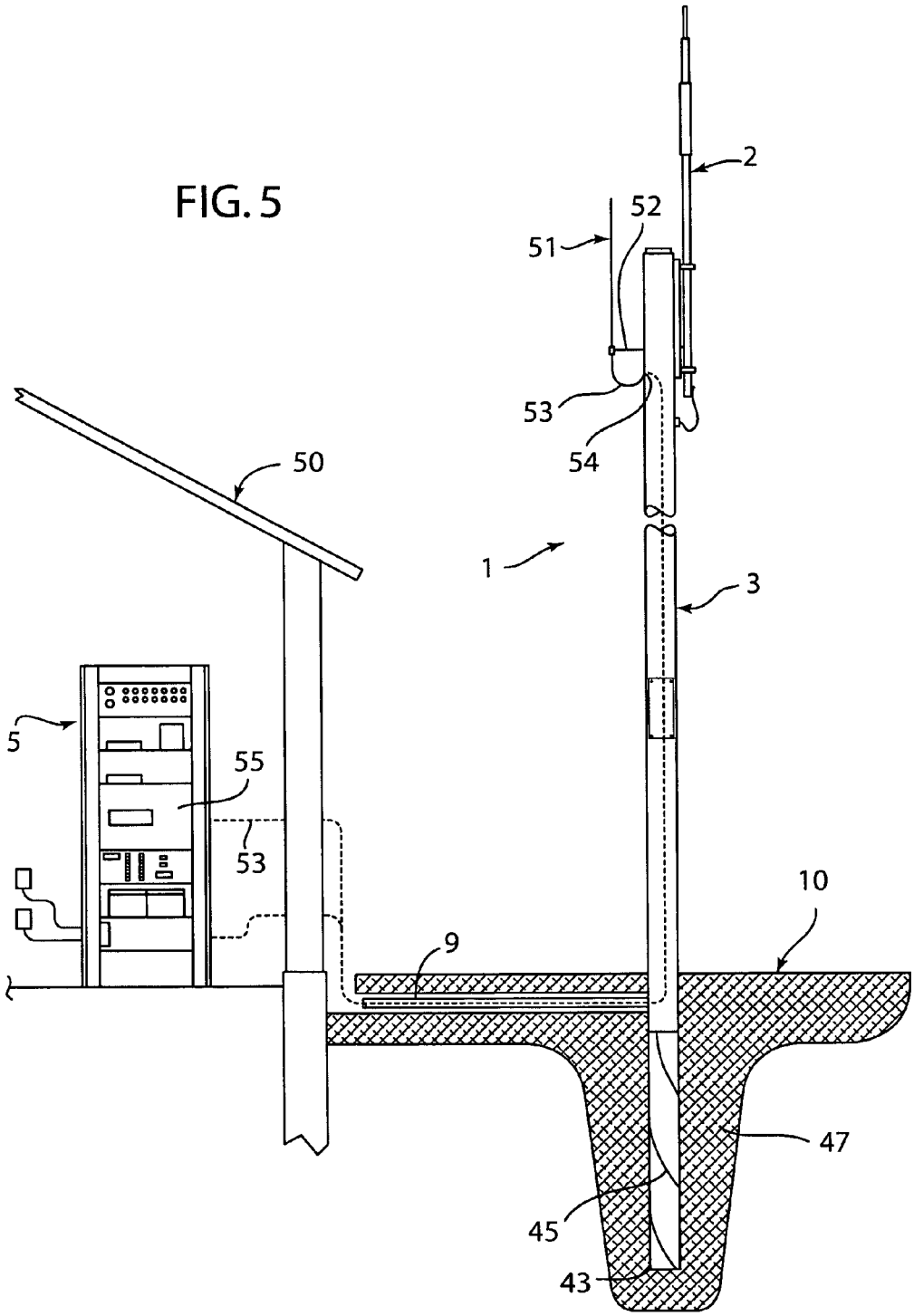
FIG. 5 is a partially schematic elevational view of an antenna and transmitting system according to another aspect of the present invention.

With further reference to FIG. 5, the transmitter 5 may be positioned within a building structure 50 to protect the transmitter 5 from the elements. Also, a receiving antenna 51 may be mounted to the tube 3 for receiving radio signals. A bracket 52 secures the receiving antenna 51 to the tube 3, and the signal line 53 extends to the inside of the tube 3 via a waterproof fitting 54. The line 53 extends downwardly through the tube 3, and extends through the underground conduit 9 to a receiver 55.

Figure 6:
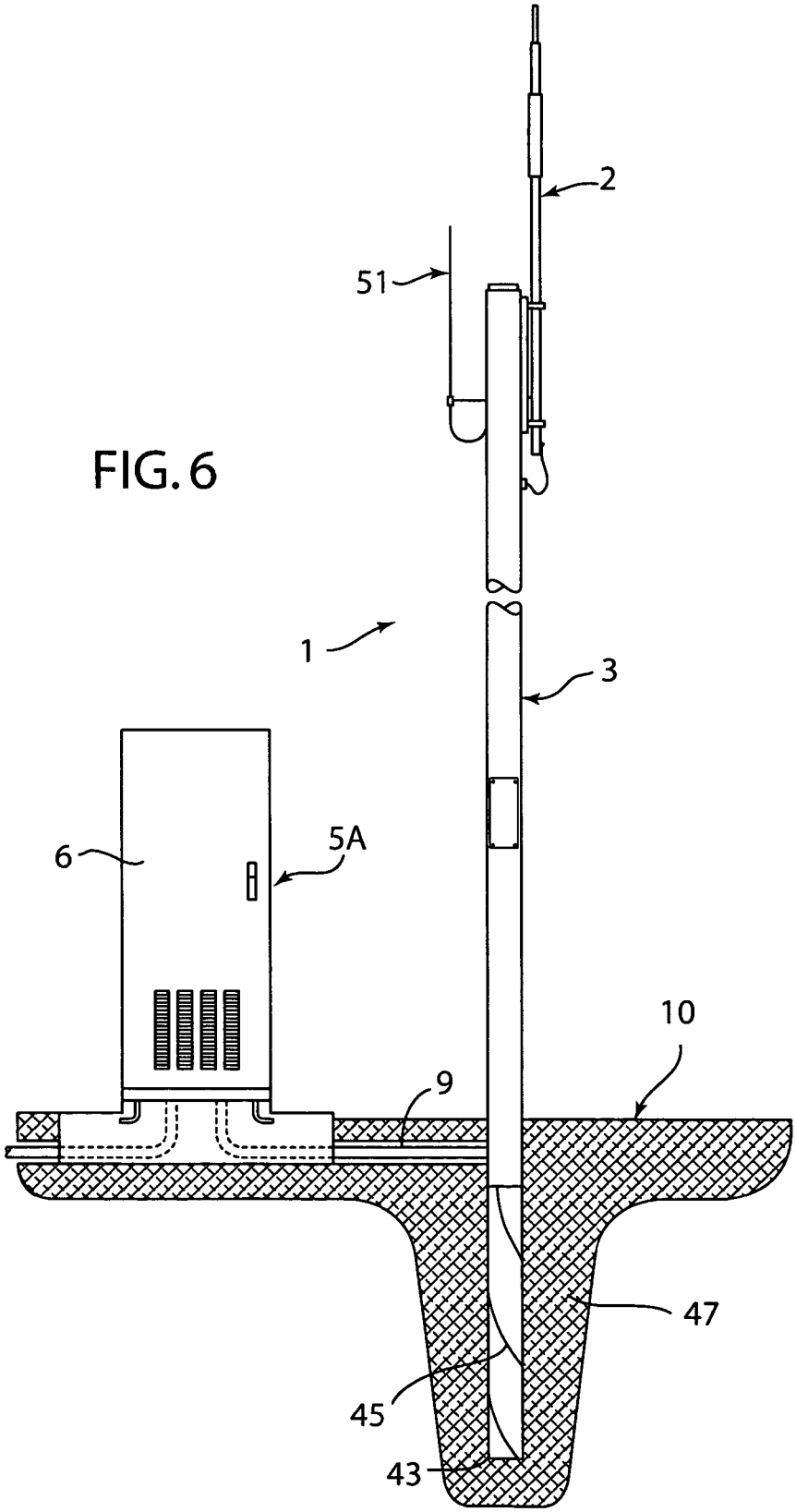
FIG. 6 is a partially schematic elevational view of an antenna and transmitting system according to another aspect of the present invention.

With further reference to FIG. 6, the transmitting system 1 may also include a transmitter 5A having a weatherproof housing 6, such that the transmitter 5A can be positioned outside in locations remote from buildings or other protective structures.

Figure 7:
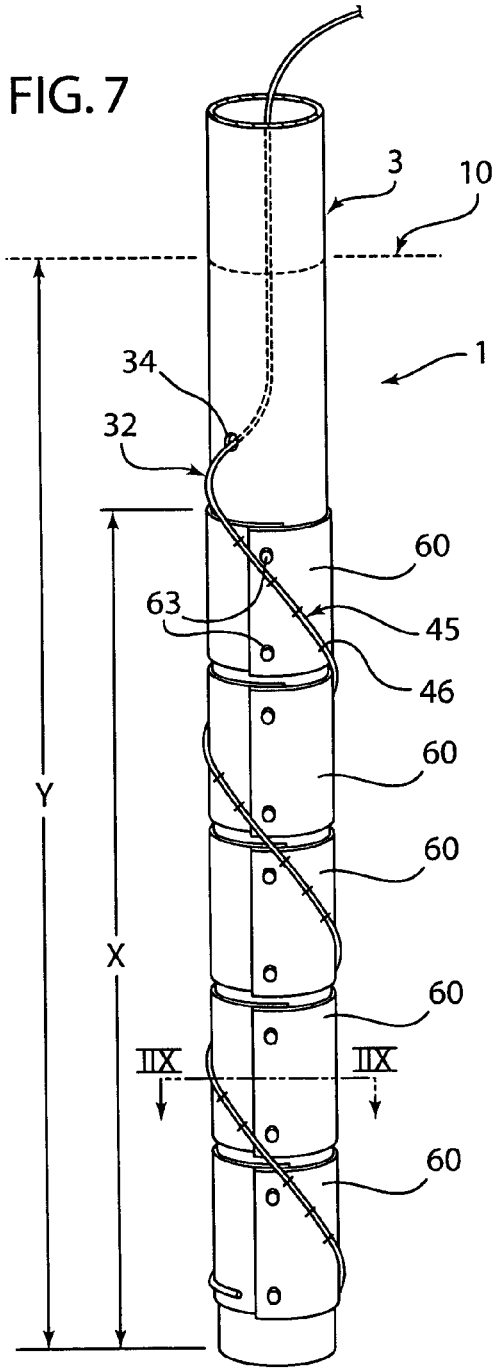
FIG. 7 is a partially fragmentary perspective view of a lower portion of a pole according to another aspect of the present invention.
Figure 8:
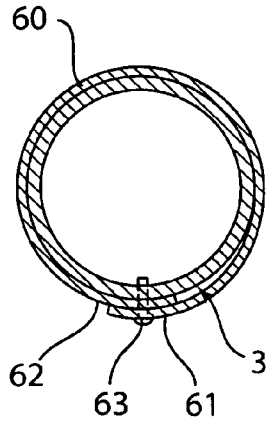
FIG. 8 is a cross-sectional view of the pole of FIG. 7 taken along the line IIX—IIX.

With further reference to FIGS. 7 and 8, the transmitting system 1 may also be grounded utilizing a plurality of plates forming rings 60 that are wrapped around the lower portion of the tube 3. The plates 60 are made of malleable copper having a thickness of 0.029 inches. Each of the plates 60 has a dimension of about 9.5 inches by about 30 inches prior to defamation of the plates to wrap around the pole 3. As illustrated in FIG. 8, the end portions 62 of the plates overlap, and the plates 60 are secured to the tube 3 utilizing a plurality of rivets 63 or the like. The ground wire 32 wraps around the plates 60, and is secured to the plates 60 utilizing brazing 46 at a plurality of locations along the lower portion 45 of ground wire 32.

The antenna support structure and grounding system described above provides a very effective ground for the antenna, without requiring a large ground plane or the like. The tube retains the cables internally, thereby protecting the cables from exposure to the elements. The grounding plates and/or conductive elements positioned on the outside of the tube below ground provide a secure electrical connection to the ground, thereby providing a very effective connection for grounding of the antenna system. The tube 3 is very durable, and a sufficient length of the tube is positioned in the ground to ensure that the antenna system remains in an upright position, with the antenna 2 positioned at the desired height to provide proper transmission.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An antenna system including an electrical grounding system for a low power radio transmitter of a traveler's information station, comprising:

an elongated metallic tube having a lower portion configured to be received in the ground and an upper portion adapted to support an antenna above ground, and an intermediate portion at a service height when the tube is positioned upright in the ground;

an antenna structure secured to the upper portion of the tube and positioned at least partially outside the tube;

at least one elongated conductive ground member secured to a lower end portion of the tube and extending along an outside of the tube below ground and within the tube above ground, the elongated ground member being coupled to the tube above ground; and an elongated electrical conductor extending upwardly inside the tube from the intermediate portion to the upper portion of the tube, the elongated electrical conductor electrically coupled to the antenna structure.

2. The antenna system of claim 1, wherein:

the lower portion of the tube is at least about six feet long.

3. The antenna system of claim 1, wherein:

the tube is made of an aluminum material, and has a circular cross-sectional shape.

4. The antenna system of claim 1, wherein:

the elongated conductive ground member comprises a copper plate member secured to the outside of a tube and a ground wire connected to the plate member, the ground wire extending within the tube.

5. The antenna system of claim 4, wherein:

the plate member is at least about four feet long.

6. The antenna system of claim 1, wherein:

the tube includes an opening through a sidewall of the tubing at the intermediate portion; and including:

a cover closing off the opening.

7. The antenna system of claim 6, including:

a lightning arrestor coupled to the elongated electrical conductor and to the tube, the lightning arrestor positioned inside the tube adjacent the cover, such that the lightning arrestor can be selectively accessed by opening the cover.

8. A transmitter system, comprising:

an elongated metal tube defining an elongated cavity, and having a lower portion configured to be positioned below a ground level, and an upper portion configured to support an antenna above ground;

a transmitter positioned remote from the tube and generating signals in a frequency range of between approximately 530 kHz and 1,710 kHz at low power for limited range traveler's information stations;

a transmitting antenna secured to the upper portion of the tube; and a coaxial cable having a portion thereof positioned in the cavity and having an elongated inner conductor that electrically couples the transmitter to the transmitting antenna, the coaxial cable having an outer conductor electrically coupled to the tube, the coaxial cable extending through a sidewall of the lower portion of the tube and extending below ground level to the transmitter.

9. The transmitter system of claim 8, including:

a conductive grounding material secured to an outside of the lower portion of the tube.

10. The transmitter system of claim 9, wherein:

the tube is made of aluminum, and the conductive material comprises copper.

11. The transmitter system of claim 8, wherein:

the tube has an access opening through a sidewall of the tube; and including:

a cover that selectively closes off the access opening.

12. The transmitter system of claim 8, including:

a lightning arrestor having first and second connectors for coaxial cable and grounding the outer conductor of the coaxial cable to the tube, positioned within the tube adjacent the access opening; and wherein:

the coaxial cable comprises an upper section extending within the tube from the first connector of lightning arrestor to the transmitting antenna, and a lower section extending downwardly from the second connector and through a sidewall of the tube below ground level.

13. A transmitting system, comprising:

an elongated tube made of a conductive material, the tube defining an internal cavity, an upper portion for supporting an antenna above a ground surface, and a lower portion configured to extend below ground to support the tube in a generally upright position and to electrically ground the tube;

a transmitting antenna secured to the upper portion of the tube;

an elongated electrical conductor coupled to the transmitting antenna and extending through the internal cavity and exiting the tube below ground at the lower portion of the tube; and a transmitter generating transmitting signals to the antenna through the elongated electrical conductor.

14. The transmitting system of claim 13, wherein:

the elongated electrical conductor includes a signal line and a ground line, the elongated electrical conductor having a pre-wired upper portion extending downwardly from the transmitting antenna to an above-ground service height of the tube, and a lower portion extending from below ground to the service height; and including:

a lightning arrestor having terminal connectors interconnecting the upper and lower portions of the elongated electrical conductor, the lightning arrestor coupling the ground lines to the tube.

15. The transmitting system of claim 14, including:

at least one copper member secured to an outside of the lower portion of the tube.

16. The transmitting system of claim 15, including:

an elongated ground conductor connected to the copper member and extending upwardly therefrom within the tube and connecting to the tube at the service height.

17. The transmitting system of claim 16, wherein:

the lower portion of the tube is at least about six feet long, the tube defining a lower end;

the copper member extends vertically at least about four feet upwardly from the lower end.

18. The transmitting system of claim 17, wherein:

a portion of the elongated ground connector wraps around the copper member, and extends through a sidewall of the tube below ground.

19. The transmitting system of claim 18, wherein:

the tube defines a sidewall having an access opening therethrough at the service height providing access to at least one of the terminal connectors; and including:

a cover selectively closing off the access opening.

20. The transmitting system of claim 13, wherein:

the transmitter generates a signal in the range of about 530 kHz to about 1,710 kHz.

21. The transmitting system of claim 13, wherein:

the tube is made of aluminum and has an overall length of at least about twenty-four feet.

22. An antenna system including an electrical grounding system for a low power radio transmitter of a traveler's information station, comprising:

an elongated pole comprising a tube defining an elongated internal cavity wherein the pole is made of a conductive material and has a highly conductive lower portion configured to be received in the ground to form an electrical ground for an antenna, and an upper portion adapted to support an antenna above ground, the highly conductive lower portion of the pole comprising an elongated ground member made of a highly conductive material secured to the outside of the tube;

an antenna structure secured to the upper portion of the pole;

an elongated electrical conductor extending upwardly along the pole and connecting to the antenna structure and providing signals to the antenna structure, wherein at least a portion of the elongated electrical conductor extends within the internal cavity; and wherein:

the elongated ground member comprises a copper plate member secured to the outside of a tube and a ground wire connected to the plate member.

23. An antenna system including an electrical grounding system for a low power radio transmitter of a traveler's information station, comprising:

an elongated pole comprising a tube defining an elongated internal cavity wherein the pole is made of a conductive material and has a highly conductive lower portion configured to be received in the ground to form an electrical ground for an antenna, and an upper portion adapted to support an antenna above ground, the highly conductive lower portion of the pole comprising an elongated ground member made of a highly conductive material secured to the outside of the tube;

an antenna structure secured to the upper portion of the pole;

an elongated electrical conductor extending upwardly along the pole and connecting to the antenna structure and providing signals to the antenna structure, wherein at least a portion of the elongated electrical conductor extends within the internal cavity; and wherein:

the plate member is at least about four feet long.

24. An antenna system including an electrical grounding system for a low power radio transmitter of a traveler's information station, comprising:

an elongated pole having a highly conductive lower portion configured to be received in the ground to form an electrical ground for an antenna, and an upper portion adapted to support an antenna above ground, the highly conductive lower portion of the pole comprising a plurality of copper members wrapped around the pole to form rings;

an antenna structure secured to the upper portion of the pole;

an elongated electrical conductor extending upwardly along the pole and connecting to the antenna structure and providing signals to the antenna structure.

25. An antenna system including an electrical grounding system for a low power radio transmitter of a traveler's information station, comprising:

an elongated pole having a highly conductive lower portion configured to be received in the ground to form an electrical ground for an antenna, and an upper portion adapted to support an antenna above ground, the highly conductive lower portion of the pole comprising a plurality of copper members wrapped around the pole to form rings, and wherein end portions of the copper members overlap;

an antenna structure secured to the upper portion of the pole;

an elongated electrical conductor extending upwardly along the pole and connecting to the antenna structure and providing signals to the antenna structure;

and including:

fasteners extending through the overlapping end portions and into the pole.

* * * * *